US010975695B2

(12) United States Patent
Wang et al.

(10) Patent No.: US 10,975,695 B2
(45) Date of Patent: Apr. 13, 2021

(54) HYDRAULIC SUPPORT MONITORING SUPPORT POSE IN REAL TIME BASED ON INERTIA MEASUREMENT UNIT AND DETECTION METHOD THEREOF

(71) Applicants: CHINA UNIVERSITY OF MINING AND TECHNOLOGY, Xuzhou (CN); XUZHOU GOLDFLUID HYDRAULIC TECHNOLOGY DEVELOPMENT CO., LTD., Xuzhou (CN)

(72) Inventors: Zhongbin Wang, Xuzhou (CN); Xuliang Lu, Xuzhou (CN); Chao Tan, Xuzhou (CN); Haifeng Yan, Xuzhou (CN); Lei Si, Xuzhou (CN); Xingang Yao, Xuzhou (CN)

(73) Assignees: CHINA UNIVERSITY OF MINING AND TECHNOLOGY, Xuzhou (CN); XUZHOU GOLDFLUID HYDRAULIC TECHNOLOGY DEVELOPMENT CO., LTD., Xuzhou (CN)

( * ) Notice: Subject to any disclaimer, the term of this patent is extended or adjusted under 35 U.S.C. 154(b) by 0 days.

(21) Appl. No.: 16/766,712

(22) PCT Filed: Jun. 18, 2019

(86) PCT No.: PCT/CN2019/091625

§ 371 (c)(1),
(2) Date: May 25, 2020

(87) PCT Pub. No.: WO2020/133957

PCT Pub. Date: Jul. 2, 2020

(65) Prior Publication Data

US 2021/0010373 A1 Jan. 14, 2021

(30) Foreign Application Priority Data

Dec. 29, 2018 (CN) ..... 201811632720.4

(51) Int. Cl.
*E21D 15/00* (2006.01)
*E21D 15/51* (2006.01)
*E21D 23/04* (2006.01)

(52) U.S. Cl.
CPC ..... *E21D 15/51* (2013.01); *E21D 23/04* (2013.01)

(58) Field of Classification Search
CPC ..... E21D 15/51; E21D 23/04
See application file for complete search history.

(56) References Cited

U.S. PATENT DOCUMENTS 7,775,748 B2 * 8/2010 Koenig ..... E21D 23/12 405/302

FOREIGN PATENT DOCUMENTS

CN 103899338 A 7/2014
CN 103968856 A 8/2014
(Continued)

OTHER PUBLICATIONS

Lin Zhang, et al., Research on Key Technologies of Autonomous Following Mining Machine for Hydraulic Support, China University of Mining & Technology, Oct. 2017.

*Primary Examiner* — Janine M Kreck
(74) *Attorney, Agent, or Firm* — Bayramoglu Law Offices LLC

(57) ABSTRACT

A hydraulic support monitoring a support pose in real time based on an inertia measurement unit (IMU) and a detection method thereof. In the hydraulic support, IMU sensors are separately mounted on a roof beam, a rear linkage, and a base, and an auxiliary support pose monitoring system is disposed. Each IMU sensor measures movement states of (Continued)

the roof beam, the rear linkage, and the base of the support in real time, and the support pose monitoring system processes the movement states to monitor a support pose of the hydraulic support in real time. Especially, it can be technically determined whether the hydraulic support is adequately lowered, moved or raised, thereby effectively reducing the labor intensity of workers and improving the working efficiency of the hydraulic support.

10 Claims, 3 Drawing Sheets

(56) References Cited

FOREIGN PATENT DOCUMENTS

| | | | |
|---|---|---|---|
| CN | 105909294 | A | 8/2016 |
| CN | 106709090 | A | 5/2017 |
| CN | 109751070 | A | 5/2019 |
| GB | 2316973 | B | 12/2000 |

* cited by examiner

HYDRAULIC SUPPORT MONITORING SUPPORT POSE IN REAL TIME BASED ON INERTIA MEASUREMENT UNIT AND DETECTION METHOD THEREOF

CROSS REFERENCES TO THE RELATED APPLICATIONS

This application is the national phase entry of International Application No. PCT/CN2019/091625, filed on Jun. 18, 2019, which is based upon and claims priority to Chinese Patent Application No. 201811632720.4, filed on Dec. 29, 2018, the entire contents of which are incorporated herein by reference.

TECHNICAL FIELD

The present invention relates to a hydraulic support monitoring a support pose in real time based on an inertia measurement unit (IMU) applicable to the field of automation control of coal mine underground devices.

The present invention further relates to a method for detecting a support pose of a hydraulic support in real time based on an IMU.

BACKGROUND

Coal is important basic energy and an important raw material in China, accounting for 62% of China's total energy consumption. China is currently the largest coal producer and consumer in the world. Moreover, China's energy occurrence condition of being oil poor and gas short also determines the current dependence on coal.

The environment of coal mine underground fully-mechanized working faces is severe, and high labor intensity is harmful to miners' health and even endangers their life. With the development of science and technology in China, new automation control technologies keep being introduced in the coal mine industry. Therefore, the automation in the coal mine industry is gradually improved, and working conditions of workers are improved to some extent. However, complex and severe working conditions at fully-mechanized working faces still endanger the health and life of workers. Such harms can be effectively avoided by implementing mining with fewer or no workers at working faces. Moreover, conventional coal mining mainly relies on workers. Particularly, dozens to hundreds of hydraulic supports are used at a fully-mechanized face. Manual operations are not enough to accurately determine support states of the supports. It is neither reliable nor efficient to adjust support states based on working experience.

There is no effective method for sensing a support pose. According to mechanisms of a hydraulic support, a support pose can be obtained as soon as a real-time length of an actuating cylinder of the support is measured. However, due to the restriction of a coupling effect between the mechanisms of the hydraulic support and a severe underground environment, it is impossible to use a sensor to directly measure the length of the actuating cylinder to obtain the support pose.

A main mechanism of a hydraulic support includes two degrees of freedom, and a movement state may be determined by using two driving members. As the hydraulic support moves, lengths of a column and a balance jack that are used as driving parts of the hydraulic support determine the support pose of the hydraulic support. However, due to a severe underground environment and a limitation of conditions, the length of the actuating cylinder cannot be directly measured by using a sensor.

SUMMARY

In view of the defects in the prior art, the present invention provides a hydraulic support monitoring a support pose in real time based on an IMU. IMU sensors are mounted on a roof beam, a rear linkage, and a base, and an auxiliary support pose monitoring system is disposed. Movement states of the roof beam, the rear linkage, and the base are measured to monitor a support pose of the hydraulic support in real time. Especially, it can be technically guided to lower, move or raise the hydraulic support, thereby effectively reducing the labor intensity of workers and improving the working efficiency of the hydraulic support.

To achieve the foregoing technical objective, the present invention uses the following technical solutions:

A hydraulic support monitoring a support pose in real time based on an IMU includes a base, a roof beam, a gob shield, a front linkage, a rear linkage, a column, and a balance jack. The roof beam is supported above the base by the column, a tail end of the roof beam is hinged to one end of the gob shield, and the other end of the gob shield is provided with a site C and a site D that are spaced apart from each other. The site C and the site D of the gob shield are respectively hinged to a site A and a site B on the base by the front linkage and the rear linkage, to form a four-linkage support mechanism. One end of the balance jack is connected to the roof beam, and the other end is connected to the gob shield. The hydraulic support further includes three IMU sensors and a support pose monitoring system. The three IMU sensors are a first IMU sensor, a second IMU sensor, and a third IMU sensor. The first IMU sensor is mounted on the roof beam, and is configured to detect attitude angle information of the roof beam and feed the attitude angle information back to the support pose monitoring system. The second IMU sensor is mounted on the rear linkage, and is configured to detect attitude angle information of the rear linkage and feed the attitude angle information back to the support pose monitoring system. The third IMU sensor is mounted on the base, and is configured to detect attitude angle information of the base and feed the attitude angle information back to the support pose monitoring system. The support pose monitoring system includes an attitude angle information acquisition module, an attitude angle information analysis and processing module, and a support pose output module. The attitude angle information acquisition module can receive the attitude angle information detected by each IMU sensor, and transmit the attitude angle information to the attitude angle information analysis and processing module. The attitude angle information analysis and processing module can receive the attitude angle information transmitted by the attitude angle information acquisition module, perform conversion calculation by combining the received attitude angle information with the length of each bar in the four-linkage support mechanism and according to a D-H matrix coordinate conversion principle, to obtain a support height h of the hydraulic support, and compare the obtained support height h with support height target values after the support is lowered, moved or raised, to determine whether the support is adequately lowered, moved or raised, thereby monitoring a support pose of the hydraulic support in a process of lowering, moving or raising the hydraulic support.

As a further improvement of the present invention, the attitude angle information analysis and processing module includes a D-H coordinate conversion module, implementing coordinate conversion by using an absolute coordinate system $\{O_0\}$ and a D-H coordinate system. The D-H coordinate system includes a base coordinate system $\{O_1\}$, a rear linkage coordinate system $\{O_2\}$, a gob shield coordinate system $\{O_3\}$, and a roof beam coordinate system $\{O_4\}$. In the absolute coordinate system $\{O_0\}$, a horizontal direction of a longitudinal plane of the support is used as an X-axis direction, an upward direction perpendicular to the X axis in the longitudinal plane of the support is used as a Y-axis direction, and an outward direction perpendicular to the longitudinal plane of the support is used as a Z-axis direction. The base coordinate system {O1} is a D-H coordinate system established by using a point O as the origin; the rear linkage coordinate system $\{O_2\}$ is a D-H coordinate system established by using a joint site A between the rear linkage and the base as the origin; the gob shield coordinate system $\{O_3\}$ is a D-H coordinate system established by using a joint site C between the gob shield and the rear linkage as the origin; and the roof beam coordinate system $\{O_4\}$ is a D-H coordinate system established by using a joint site F between the roof beam and the gob shield as the origin. The D-H coordinate conversion module includes a joint rotation angle conversion module and a support pose conversion module. The joint rotation angle conversion module can perform geometric conversion according to the received attitude angle information and by combining the length of each bar in the four-linkage support mechanism to respectively obtain a joint rotation angle $\theta_1$ of the base, a joint rotation angle $\theta_2$ of the rear linkage, a joint rotation angle $\theta_3$ of the gob shield, a joint rotation angle $\theta_4$ of the roof beam, and transmit the obtained joint rotation angles to the support pose conversion module. The support pose conversion module obtains the support height h of the hydraulic support according to a D-H coordinate conversion principle, by using a D-H matrix analysis method, and by combining each joint rotation angle transmitted by the joint rotation angle conversion module.

Another technical objective of the present invention is to provide a detection method of a hydraulic support monitoring a support pose based on an IMU. In a step of lowering, moving or raising a hydraulic support in the detection method, a support pose of the hydraulic support needs to be monitored in real time to determine whether the hydraulic support has been lowered, moved or raised to reach a target support pose, where the support pose of the hydraulic support is represented by an attitude angle of a roof beam and a support height h of a support height reference point K selected on the roof beam. The detection method includes the following steps:

(1) in a process of lowering, moving or raising the support, recording pose information fed back by each IMU sensor in real time to update an attitude angle of a component on which the IMU sensor is mounted, where there are three IMU sensors, which are a first IMU sensor mounted on the roof beam, a second IMU sensor mounted on a rear linkage, and a third IMU sensor mounted on a base;

(2) performing coordinate conversion and geometric conversion by combining the pose information detected by each IMU sensor in an absolute coordinate system with the length of each bar in a four-linkage support mechanism to respectively obtain a joint rotation angle $\theta_1$ of the base, a joint rotation angle $\theta_2$ of the rear linkage, a joint rotation angle $\theta_3$ of the gob shield, and a joint rotation angle $\theta_4$ of the roof beam; and (3) performing coordinate conversion between an absolute coordinate system $\{O_0\}$ and a D-H coordinate system according to a D-H matrix coordinate transformation principle, according to the obtained joint rotation angle $\theta_1$ of the base, joint rotation angle $\theta_2$ of the rear linkage, joint rotation angle $\theta_3$ of the gob shield, and joint rotation angle $\theta_4$ of the roof beam, and by combining structural parameters of the hydraulic support and the attitude angle of the roof beam fed back by the first IMU sensor to obtain the support height h, where the support height h is expressed by a vertical distance between the support height reference point K and the origin O of the base in a Y-axis direction.

In the absolute coordinate system $\{O_0\}$, a horizontal direction of a longitudinal plane of the support is used as an X-axis direction, an upward direction perpendicular to the X axis in the longitudinal plane of the support is used as a Y-axis direction, and an outward direction perpendicular to the longitudinal plane of the support is used as a Z-axis direction. The base coordinate system $\{O_1\}$ is a D-H coordinate system established by using a point O as the origin; the rear linkage coordinate system $\{O_2\}$ is a D-H coordinate system established by using a joint site A between the rear linkage and the base as the origin; the gob shield coordinate system $\{O_3\}$ is a D-H coordinate system established by using a joint site C between the gob shield and the rear linkage as the origin; and the roof beam coordinate system $\{O_4\}$ is a D-H coordinate system established by using a joint site F between the roof beam and the gob shield as the origin.

It is determined, by comparing the calculated support height h with support height target values after the support is lowered, moved or raised, whether the hydraulic support is adequately lowered, moved or raised.

If in the lowering process, the calculated support height h is the same as a support height target value of lowering, it indicates that the support is adequately lowered, and the support starts to be moved; otherwise, the support continues being lowered;

if in the moving process, the calculated support height h is the same as a support height target value of moving, it indicates that the support is adequately moved, and the support starts to be raised; otherwise, the support continues being moved; and if in the raising process, the calculated support height h is the same as a support height target value of raising, it indicates that the support is adequately raised, and the entire operation procedure of the hydraulic support is ended; otherwise, the support continues being raised.

According to the foregoing technical solutions, compared to the prior art, the present invention has the following advantages:

In the present invention, an IMU sensor is mounted on each of a base, a rear linkage, and a roof beam, so that movement states of the base, the rear linkage, and the roof beam may be detected in real time. A pose (an attitude angle $\vec{\alpha}_4$ of the roof beam, and a support height h) of a hydraulic support is detected in real time by using a specific data processing system. Especially, it can be technically guided to lower, move or raise the hydraulic support, thereby effectively reducing the labor intensity of workers and improving the working efficiency of the hydraulic support.

Figure 1:
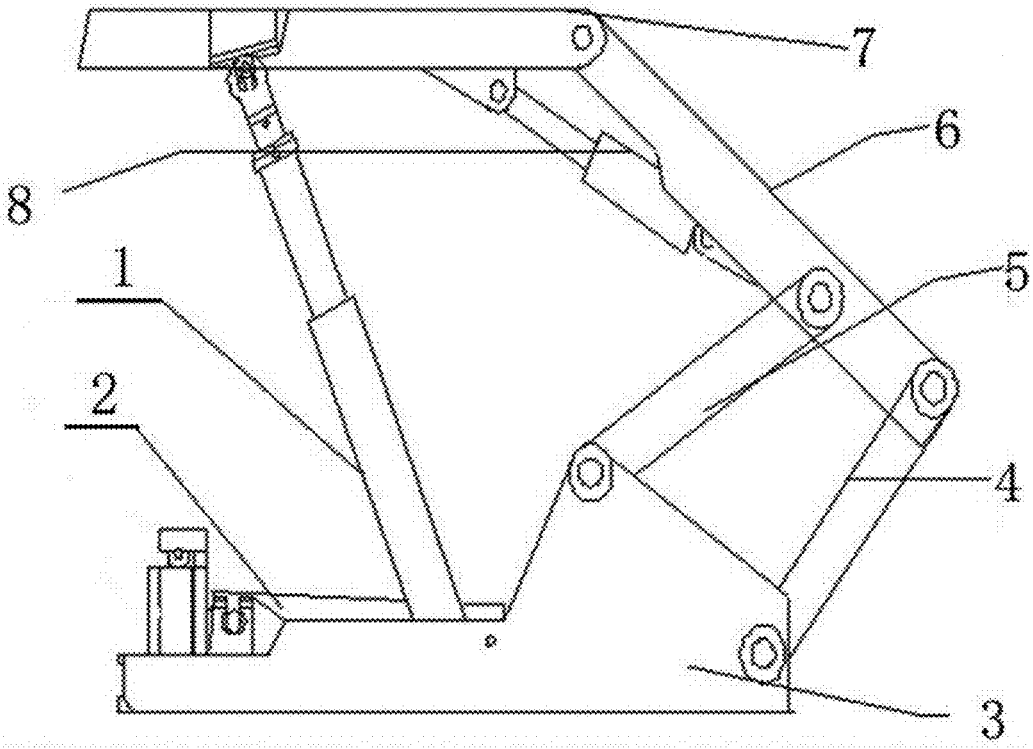
FIG. 1 is a schematic structural diagram of a hydraulic support, where in the figure: 1-column; 2-pushing device; 3-base; 4-rear linkage; 5-front linkage; 6-gob shield; 7-roof beam; and 8-balance jack.
Figure 2:
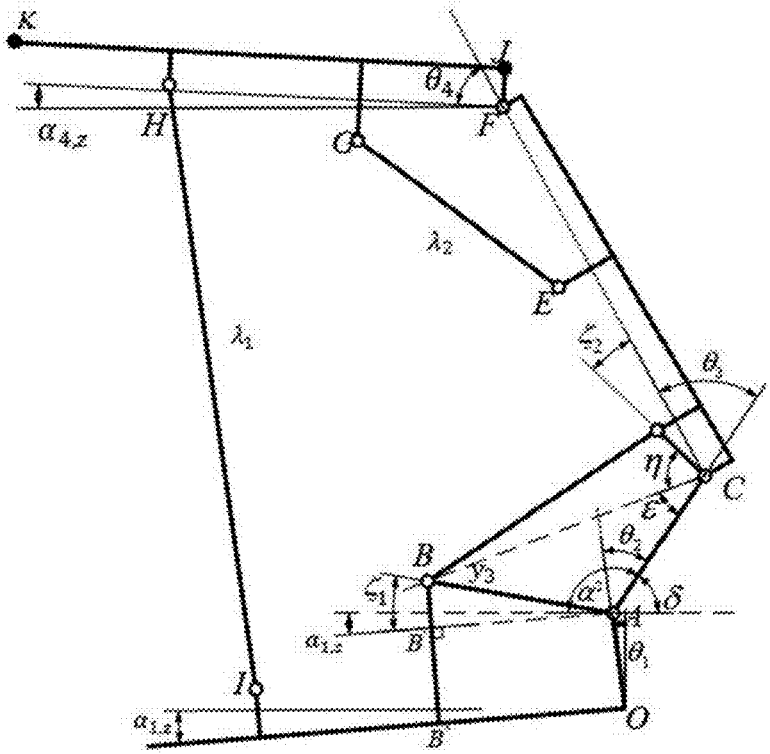
FIG. 2 is a structural diagram of a hydraulic support according to the present invention, where mounting positions of IMU sensors are not indicated, and D-H coordinate analysis of the hydraulic support is also not shown.

$\{O_0\}$ is an absolute coordinate system, in which a horizontal direction of a longitudinal plane of the hydraulic support is used as an X-axis direction, an upward direction perpendicular to the X axis is used as a Y-axis direction, and an outward direction perpendicular to the X-Y plane is used as a Z-axis direction, where the origin O is set at a tail end of a base;

$\{x_1Oy_1\}$ is a base coordinate system $\{O_1\}$, and an attitude angle of the base is $\vec{\alpha_1}=(\alpha_{1,x}, \alpha_{1,y}, \alpha_{1,z})$, where $\alpha_{1,x}$, $\alpha_{1,y}$, and $\alpha_{1,z}$ are respectively rotation angle components on the X axis, Y axis, and Z axis;

$\{x_2Ay_2\}$ is a rear linkage coordinate system $\{O_2\}$, and an attitude angle $\vec{\alpha_2}$ of a rear linkage is $\vec{\alpha_2}$ $(\alpha_{2,x}, \alpha_{2,y}, \alpha_{2,z})$, where $\alpha_{2,x}$, $\alpha_{2,y}$, and $\alpha_{2,z}$ are respectively rotation angle components on the X axis, Y axis, and Z axis;

$\{x_3Cy_3\}$ is a gob shield coordinate system $\{O_3\}$;

$\{x_4Fy_4\}$ is a roof beam coordinate system $\{O_4\}$, and a support attitude angle $\vec{\alpha_4}$ of a roof beam is $\vec{\alpha_4}=(\alpha_{4,x}, \alpha_{4,y}, \alpha_{4,z})$, where $\alpha_{4,x}$, $\alpha_{4,y}$, and $\alpha_{4,z}$ are respectively rotation angle components of the attitude angle of the roof beam on the X axis, Y axis, and Z axis; and h is a support height; $\lambda_1$ is the length of a column; $\lambda_2$ is the length of a balance jack; a joint rotation angle of the base is $\theta_1$; a joint rotation angle of the rear linkage is $\theta_2$; a joint rotation angle of the gob shield is $\theta_3$; and a joint rotation angle of the roof beam is $\theta_4$.

DETAILED DESCRIPTION OF THE EMBODIMENTS

The technical solutions in the embodiments of the present invention are described with reference to the accompanying drawings in the embodiments of the present invention. Obviously, the described embodiments are only some embodiments, rather than all embodiments, of the present invention. The description of at least one exemplary embodiment below is only for illustration, and should not be construed as any limitation on the present invention and applications or usages of the present invention. All other embodiments obtained by a person of ordinary skill in the art based on the embodiments of the present invention without creative efforts shall fall within the protection scope of the present invention. Unless otherwise specifically stated, the components and relative deployment of steps, expressions and values described in the embodiments do not limit the scope of the present invention. Moreover, it should be understood that, for ease of description, sizes of various parts shown in the accompanying drawings are not drawn according to an actual proportion relationship. Technologies, methods, and equipment known to a person of ordinary skill in the related art are not discussed in detail. However, in an appropriate case, the technologies, methods, and equipment should be regarded as a part of the authorized specification. In all the examples shown and discussed here, any specific values should be interpreted as merely exemplary and not as limitative. Therefore, different values may be used in other examples of the exemplary embodiments.

For ease of description, spatial relative terms such as "above", "under", "above the upper surface", "upper", can be used here to describe spatial location relationships between a device or feature and other devices or features as shown in the figure. It should be understood that, the spatial relative terms are used to include different directions in use or operation in addition to the directions of the device described in the figure. For example, if the device in the accompanying drawings is inverted, the device described as "being above or on another device" or construction shall be positioned as "being below or under another device or construction". Therefore, the exemplary term "above" may include two directions of "above" or "below".

As shown in FIG. 1 to FIG. 4, a hydraulic support monitoring a support pose in real time based on an IMU includes a base, a roof beam, a gob shield, a front linkage, a rear linkage, a column, and a balance jack. The roof beam is supported above the base by the column, a tail end of the roof beam is hinged to one end of the gob shield, and the other end of the gob shield is provided with a site C and a site D that are spaced apart from each other. The site C and the site D of the gob shield are respectively hinged to a site A and a site B on the base by the front linkage and the rear linkage, to form a four-linkage support mechanism. One end of the balance jack is connected to the roof beam, and the other end is connected to the gob shield. The hydraulic support further includes three IMU sensors and a support pose monitoring system. The three IMU sensors are a first IMU sensor, a second IMU sensor, and a third IMU sensor. The first IMU sensor is mounted on the roof beam, and is configured to detect attitude angle information of the roof beam and feed the attitude angle information back to the support pose monitoring system. The second IMU sensor is mounted on the rear linkage, and is configured to detect attitude angle information of the rear linkage and feed the attitude angle information back to the support pose monitoring system. The third IMU sensor is mounted on the base, and is configured to detect attitude angle information of the base and feed the attitude angle information back to the support pose monitoring system. The support pose monitoring system includes an attitude angle information acquisition module, an attitude angle information analysis and processing module, and a support pose output module. The attitude angle information acquisition module can receive the attitude angle information detected by each IMU sensor, and transmit the attitude angle information to the attitude angle information analysis and processing module. The attitude angle information analysis and processing module can receive the attitude angle information transmitted by the attitude angle information acquisition module, perform conversion calculation by combining the received attitude angle information with the length of each bar in the four-linkage support mechanism and according to a D-H matrix coordinate conversion principle, to obtain a support height h of the hydraulic support, and compare the obtained support height h with support height target values after the support is lowered, moved or raised, to determine whether the support is adequately lowered, moved or raised, thereby monitoring a support pose of the hydraulic support in a process of lowering, moving or raising the hydraulic support.

The attitude angle information analysis and processing module includes a D-H coordinate conversion module, implementing coordinate conversion by using an absolute coordinate system $\{O_0\}$ and a D-H coordinate system. The D-H coordinate system includes a base coordinate system $\{O_1\}$, a rear linkage coordinate system $\{O_2\}$, a gob shield coordinate system $\{O_3\}$, and a roof beam coordinate system $\{O_4\}$. In the absolute coordinate system $\{O_0\}$, a horizontal direction of a longitudinal plane of the support is used as an X-axis direction, an upward direction perpendicular to the X axis in the longitudinal plane of the support is used as a Y-axis direction, and an outward direction perpendicular to the longitudinal plane of the support is used as a Z-axis direction. The base coordinate system {O1} is a D-H coordinate system established by using a point O as the origin; the rear linkage coordinate system $\{O_2\}$ is a D-H coordinate system established by using a joint site A between the rear linkage and the base as the origin; the gob shield coordinate system $\{O_3\}$ is a D-H coordinate system established by using a joint site C between the gob shield and the rear linkage as the origin; and the roof beam coordinate system $\{O_4\}$ is a D-H coordinate system established by using a joint site F between the roof beam and the gob shield as the origin. The D-H coordinate conversion module includes a joint rotation angle conversion module and a support pose conversion module. The joint rotation angle conversion module can perform geometric conversion according to the received attitude angle information and by combining the length of each bar in the four-linkage support mechanism to respectively obtain a joint rotation angle $\theta_1$ of the base, a joint rotation angle $\theta_2$ of the rear linkage, a joint rotation angle $\theta_3$ of the gob shield, a joint rotation angle $\theta_4$ of the roof beam, and transmit the obtained joint rotation angles to the support pose conversion module. The support pose conversion module obtains the support height h of the hydraulic support according to a D-H coordinate conversion principle, by using a D-H matrix analysis method, and by combining each joint rotation angle transmitted by the joint rotation angle conversion module.

The support pose conversion module expresses the support height h by using a vertical distance between a support height reference point K and the origin O of the base in a Y-axis direction:

$$h=P(x_k^0,y_k^0,0)^Y-P(0,0,0)^Y$$

In the expression: a pose $P(x_K^0, y_K^0, 0)$ of the support height reference point K in the longitudinal plane of the hydraulic support is determined by using the following expression:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix}$$

A specific manner of verifying effectiveness of an x axis $\hat{n}=(n_x, n_y, n_z)=\hat{o}\times\hat{a}$ of the roof beam in an absolute coordinate system in the pose $P(x_K^0, y_K^0, 0)$ is that: a calculated value $\overrightarrow{\alpha'_4}=(\alpha'_{4,x}, \alpha'_{4,y}, \alpha'_{4,z})$ of an attitude angle of the roof beam of the hydraulic support may be calculated by using the following expression:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

The calculated value $\overrightarrow{\alpha'_4}$ of the attitude angle of the roof beam calculated by using the foregoing expression is compared with the attitude angle $\overrightarrow{\alpha_4}$ of the roof beam detected by the first IMU sensor mounted on the roof beam. If a difference between the two values is within an allowable error range, the support height h may be calculated by using an expression of the support height h; and if the difference between the two values is beyond the allowable error range (when conditions occur underground, for example, when the hydraulic support suffers from relatively severe shock by surrounding rocks or roof plates, a calculation error may occur), the hydraulic support needs to be initialized.

The support height reference point K is any point on the roof beam; $P(x_k^0, y_k^0, 0)^Y$ is a coordinate component of a pose of the point K in the absolute coordinate system $\{O_0\}$ on the Y axis; $P(0, 0, 0)^Y$ is a coordinated component of a pose of the origin O in the absolute coordinate system $\{O_0\}$ on the Y axis; and $P(x_K^0, y_K^0, 0)$ is a coordinate value of the support height reference point K in the absolute coordinate system $\{O_0\}$.

$T_0^1(\theta_1)$ is the transformation matrix of the base coordinate system $\{O_1\}$ relative to the absolute coordinate system $\{O_0\}$; $T_1^2(\theta_2)$ is the transformation matrix of the rear linkage coordinate system $\{O_2\}$ relative to the base coordinate system $\{O_1\}$; $T_2^3(\theta_3)$ is the transformation matrix of the gob shield coordinate system $\{O_3\}$ relative to the rear linkage coordinate system $\{O_2\}$; and $T_3^4(\theta_4)$ is the transformation matrix of the roof beam coordinate system $\{O_4\}$ relative to the gob shield coordinate system $\{O_3\}$.

$P(x_K^4, y_K^4, 0)$ represents the pose of the point K in the roof beam coordinate system $\{O_4\}$, and is determined by structural parameters of the hydraulic support; and the foregoing coordinate conversion matrix $T_{i-1}^i(\theta_i)$ represents the transformation matrix of a joint site of the hydraulic support in $\{O_i\}$ relative to a coordinate system $\{O_{i-1}\}$, and is constructed by using D-H matrix parameters, where the D-H matrix parameters include a joint rotation angle $\theta_i$, an offset $d_i$, and a torsion angle, and a linkage length $l_i$ (i=1, 2, 3, . . . ).

$\theta_1$, $\theta_2$, $\theta_3$, and $\theta_4$ respectively represent a rotation angle of the base, a rotation angle of the rear linkage, a rotation angle of the gob shield, and a rotation angle of the roof beam.

$\hat{a}=(a_x, a_y, a_z)$ is referred to as an approach vector, which represents a z axis of the roof beam in the absolute coordinate system; $\hat{o}=(o_x, o_y, o_z)$ is referred to as an attitude vector, which represents a y axis of the roof beam in the absolute coordinate system; and $\hat{n}=(n_x, n_y, n_z)=\hat{o}\times\hat{a}$ is referred to as an x axis of the roof beam in the absolute coordinate system.

In the joint rotation angle conversion module, the joint rotation angle $\theta_1$ of the base, the joint rotation angle $\theta_2$ of the rear linkage, the joint rotation angle $\theta_3$ of the gob shield, and the joint rotation angle $\theta_4$ of the roof beam are calculated by using the following expression:

$$\begin{cases} \theta_1 = \alpha_{1,z} \\ \theta_2 = \alpha_{2,z} + \theta_1 - \pi/2 \\ \theta_3 = \pi - \varepsilon - \eta - \xi_2 \\ \theta_4 = \pi/2 + \alpha_{4,z} - \theta_1 + \theta_2 - \theta_3 \end{cases}$$

where $\alpha_{1,z}$ is a component of an attitude angle of the base in the absolute coordinate system $\{O_0\}$ in a Z direction; $\alpha_{2,z}$ is a component of an attitude angle of the rear linkage in the absolute coordinate system $\{O_0\}$ in the Z direction; $\alpha_{4,z}$ is a component of an attitude angle of the roof beam in the absolute coordinate system $\{O_0\}$ in the Z direction; $\xi_1$ and $\xi_2$ are structural parameters of the hydraulic support, and $\varepsilon$ and $\eta$ are intermediate parameters; and expressions of the structural parameters $\xi_1$ and $\xi_2$ of the hydraulic support and the intermediate parameters $\varepsilon$ and $\eta$ are as follows:

$$\xi_1 = \arcsin\left(\frac{l_{BB^*} - l_{0A}}{l_{AB}}\right)$$

$$\xi_2 = arcos\left(\frac{l_{CC^*}}{l_{CD}}\right)$$

$$\varepsilon = \arccos\frac{(l_{AC})^2 + (l_{BC})^2 - (l_{AB})^2}{2l_{AC}l_{BC}}$$

$$\eta = \arccos\frac{(l_{BC})^2 + (l_{CD})^2 - (l_{BD})^2}{2l_{CD}l_{BC}}$$

In the expressions: $l_{AB}$ is a distance between the joint site A and the joint site B in the four-linkage support mechanism; $l_{BC}$ is a distance between the joint site B and the joint site C in the four-linkage support mechanism, where $l_{BC}=\sqrt{(l_{AC})^2+(l_{AB})^2+2l_{AC}l_{BC}\cos(\alpha_{1,z}+\alpha_{2,z}-\xi_1)}$; $l_{AC}$ is a distance between the joint site A and the joint site C in the four-linkage support mechanism; $l_{CD}$ is a distance between the joint site D and the joint site C in the four-linkage support mechanism; $l_{CC^*}$ is a distance between the joint site C and DC* in the four-linkage support mechanism, where C* is a foot point; $l_{BD}$ is a distance between the joint site B and the joint site D in the four-linkage support mechanism; $l_{BB^*}$ is a distance between the joint site B and the base in the four-linkage support mechanism, where B* is a foot point of the joint site B on the base; and $l_{OA}$ is a distance between the joint site A and the origin O of the absolute coordinate system $\{O_0\}$ on the base in the hydraulic support.

In step (2), expressions of the joint rotation angle $\theta_1$ of the base, the joint rotation angle $\theta_2$ of the rear linkage, the joint rotation angle $\theta_3$ of the gob shield, and the joint rotation angle $\theta_4$ of the roof beam are calculated by using the following steps:

2.1. first, calculating coordinates of the joint sites A, B, C, and D in the coordinate system $\{O_2\}$ in the four-linkage support mechanism formed by the base, the front linkage, the rear linkage, and the gob shield, which are respectively A(0, 0), B($l_{AB}$ sin($\alpha_{2,z}+\alpha_{1,z}-\xi_1$), ($l_{AB}$ cos($\alpha_{2,z}+\alpha_{1,z}-\xi_1$)), C(0, $l_{AC}$), and D($x_C^2$−lCD sin ε+θ,γC2−lCD cos ε+η);

2.2. calculating the distance $l_{BC}=\sqrt{(l_{AC})^2+(l_{AB})^2+2l_{AC}l_{BC}\cos(\alpha_{1,z}+\alpha_{2,z}-\xi_1)}$ between the joint site B and the joint site C in the four-linkage support mechanism in real time; and 2.3. obtaining the expressions of the joint rotation angles $\theta_1$, $\theta_2$, $\theta_3$, and $\theta_4$ according to step 2.1 and step 2.2 and by combining intermediate parameters $\varepsilon$ and $\eta$, where each expression is as follows:

$$\begin{cases} \theta_1 = \alpha_{1,z} \\ \theta_2 = \alpha_{2,z} + \theta_1 - \pi/2 \\ \theta_3 = \pi - \varepsilon - \eta - \xi_2 \\ \theta_4 = \pi/2 + \alpha_{4,z} - \theta_1 + \theta_2 - \theta_3 \end{cases}$$

where $\alpha_{1,z}$ is a component of an attitude angle of the base in the absolute coordinate system $\{O_0\}$ in a Z direction; $\alpha_{2,z}$ is a component of an attitude angle of the rear linkage in the absolute coordinate system $\{O_0\}$ in the Z direction; $\alpha_{4,z}$ is a component of an attitude angle of the roof beam in the absolute coordinate system $\{O_0\}$ in the Z direction; $\xi_1$ and $\xi_2$ are structural parameters of the hydraulic support, and $\varepsilon$ and $\eta$ are intermediate parameters; and expressions of the structural parameters $\xi_1$ and $\xi_2$ of the hydraulic support and the intermediate parameters $\varepsilon$ and $\eta$ are as follows:

$$\xi_1 = \arcsin\left(\frac{l_{BB^*} - l_{0A}}{l_{AB}}\right)$$

$$\xi_2 = arcos\left(\frac{l_{CC^*}}{l_{CD}}\right)$$

$$\varepsilon = \arccos\frac{(l_{AC})^2 + (l_{BC})^2 - (l_{AB})^2}{2l_{AC}l_{BC}}$$

$$\eta = \arccos\frac{(l_{BC})^2 + (l_{CD})^2 - (l_{BD})^2}{2l_{CD}l_{BC}}$$

In the expressions: $l_{AB}$ is a distance between the joint site A and the joint site B in the four-linkage support mechanism; $l_{BC}$ is a distance between the joint site B and the joint site C in the four-linkage support mechanism; $l_{AC}$ is a distance between the joint site A and the joint site C in the four-linkage support mechanism; $l_{CD}$ is a distance between the joint site D and the joint site C in the four-linkage support mechanism; $l_{CC^*}$ is a distance between the joint site C and DC* in the four-linkage support mechanism, where C* is a foot point; $l_{BD}$ is a distance between the joint site B and the joint site D in the four-linkage support mechanism; $l_{BB^*}$ is a distance between the joint site B and the base in the four-linkage support mechanism, where B* is a foot point of the joint site B on the base; and $l_{OA}$ is a distance between the joint site A and the origin O of the absolute coordinate system $\{O_0\}$ on the base in the hydraulic support.

An expression of the support height h is obtained by using the following steps:

3.1. constructing the transformation matrix $T_{i-1}^{\ i}(\theta_i)$ by which a joint site of the hydraulic support in $\{O_i\}$ rotates about the Z axis in the longitudinal plane of the hydraulic support relative to the coordinate system $\{O_{i-1}\}$, where i=1, 2, 3, . . . ;

3.2. uniformly constructing $T_{i-1}^{\ i}(\theta_i)$ by using D-H matrix parameters, where the D-H matrix parameters are a rotation angle $\theta_i$, an offset $d_i$, a torsion angle, and a linkage length $l_i$;

3.3. solving a pose $P(x_x^{\ 0}, y_x^{\ 0}, z_x^{\ 0})$ of any point X on the hydraulic support in the absolute coordinate system $\{O_0\}$ by using each rotation angle $\theta_i$, where $$P(x_\times^0, y_\times^0, z_\times^0) = RPY(\alpha_{1,x}, \alpha_{1,y}, \alpha_{1,z})\prod_{i=1}^{n}\{T_{i-1}^{i}(\theta_{i-1})\}P(x_\times^i, y_\times^i, 0)$$

RPY ($\alpha_{1,x}$, $\alpha_{1,y}$, $\alpha_{1,z}$) represents a rotation matrix of the base obtained according to a roll-pitch-yaw rotation sequence;

3.4. selecting a point K on the roof beam as a support height reference point of the hydraulic support, where an expression of a pose of the point K in the absolute coordinate system $\{O_0\}$ in the longitudinal plane of the hydraulic support is as follows:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix}$$

$P(x_K^4, y_K, 0)$ represents a pose of the point K in the roof beam coordinate system $\{O_4\}$, and is determined by structural parameters of the hydraulic support;

3.5. an attitude matrix of the hydraulic support being:

$$A_4 = \begin{bmatrix} n_x & o_x & a_x \\ n_y & o_y & a_y \\ n_z & o_z & a_z \end{bmatrix}$$

3.6. verifying effectiveness of an x axis $\hat{n}=(n_x, n_y, n_z)=\hat{o}\times\hat{a}$ of the roof beam in the absolute coordinate system:

a calculated value $\vec{\alpha_4}=(\alpha'_{4,x}, \alpha'_{4,y}, \alpha'_{4,z})$ of an attitude angle of the roof beam of the hydraulic support may be calculated by using the following formula:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

the calculated value $\vec{\alpha_4}$ of the attitude angle of the roof beam calculated by using the foregoing expression is compared with the attitude angle $\vec{\alpha_4}$ of the roof beam detected by the first IMU sensor mounted on the roof beam. If a difference between the two values is within an allowable error range, it indicates that the x axis of the roof beam in the absolute coordinate system, and the support height h may be calculated by using an expression of the support height h; and if the difference between the two values is beyond the allowable error range, the hydraulic support needs to be initialized; and 3.7. an expression of the support height h of the hydraulic support:

$$h=P(x_k^0, y_k^0, 0)^Y - P(0,0,0)^Y$$

In the expression: $P(x_k^0, y_k^0, 0)$ is a coordinated component of the pose of the point K in the absolute coordinate system $\{O_0\}$ on the Y axis; and $P(0, 0, 0)^Y$ is a coordinated component of a pose of the origin O in the absolute coordinate system $\{O_0\}$ on the Y axis.

The following describes a specific embodiment of the present invention in detail with reference to the accompanying drawings.

Figure 3:
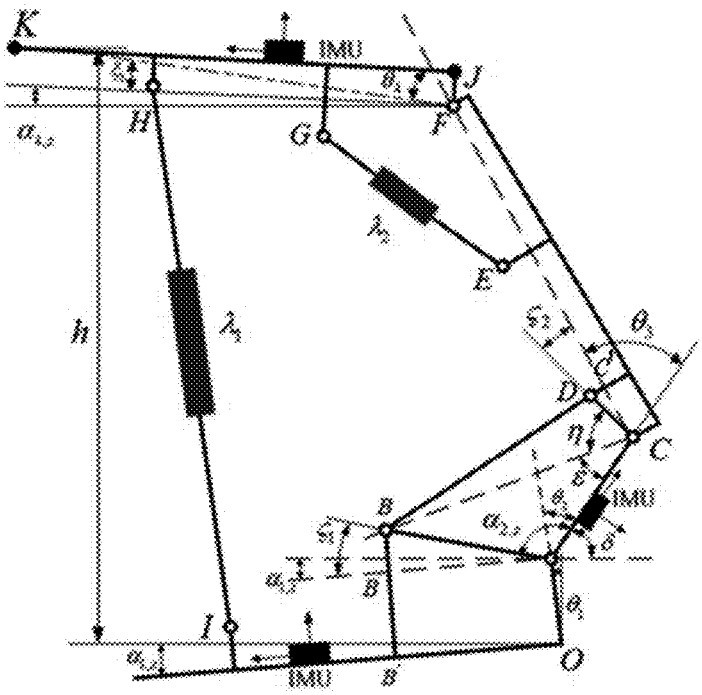
FIG. 3 is a structural diagram of a hydraulic support according to the present invention, where mounting positions of IMU sensors on a base, a roof beam, and a gob shield are indicated, and a schematic diagram of D-H coordinate analysis of the hydraulic support is provided.

First, a schematic diagram of a D-H coordinate system shown in FIG. 3 is established. $\{O_0\}$ is set as an absolute coordinate system, a horizontal direction of longitudinal plane of the support is set as a X-axis direction, an upward direction vertically perpendicular to the X axis is set as a Y-axis direction, an outward direction perpendicular to the X-Y plane is set as a Z-axis direction. $\{x_1Oy_1\}$ is a base coordinate system $\{O_1\}$, $\{x_2Ay_2\}$ is a rear linkage coordinate system $\{O_2\}$, $\{x_3Cy_3\}$ is a gob shield coordinate system $\{O_3\}$, $\{x_4Fy_4\}$ is a roof beam coordinate system $\{O_4\}$, a support height is h, and a support attitude angle of a roof beam is $\vec{\alpha_1}=(\alpha_{1,x}, \alpha_{1,y}, \alpha_{1,z})$, where $\alpha_{4,x}$, $\alpha_{4,y}$, and $\alpha_{4,z}$ are respectively rotation angle components of the attitude angle of the roof beam on the X axis, Y axis, and Z axis; an attitude angle of a base is $\vec{\alpha_1}=(\alpha_{1,x}, \alpha_{1,y}, \alpha_{1,z})$, where $\alpha_{1,x}$, $\alpha_{1,y}$, and $\alpha_{1,z}$ are respectively rotation angle components on the X axis, Y axis, and Z axis; and an attitude angle of the rear linkage is $\vec{\alpha_2}=(\alpha_{2,x}, \alpha_{2,y}, \alpha_{2,z})$, where, $\alpha_{1,x}$, $\alpha_{1,y}$, and $\alpha_{1,z}$ are respectively rotation angle components on the X axis, Y axis, and Z axis.

As shown in FIG. 3, IMU sensors are mounted on the base, the rear linkage, and the roof beam of the hydraulic support in the present invention, which may obtain all attitude variables of the hydraulic support in a detection space.

Figure 4:
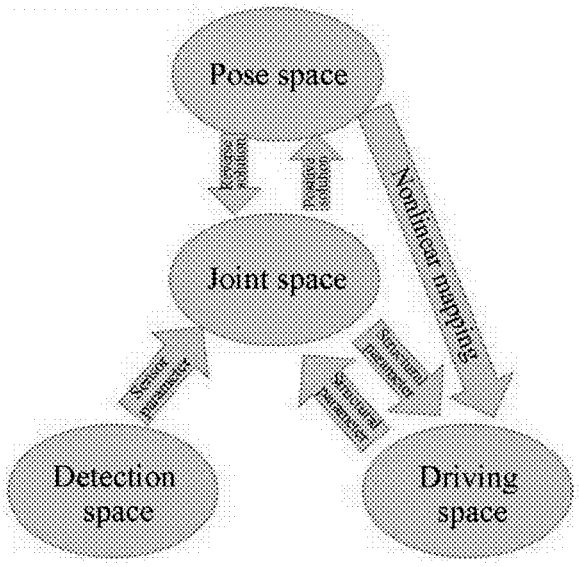
FIG. 4 is a schematic diagram of a conversion relationship between working spaces.

As shown in FIG. 4, in the present invention, working spaces of the hydraulic support may be divided into a driving space, a joint space, a pose space, and a detection space according to different variable parameters that are selected. The driving space is formed by a length h of a column and a length $\lambda_2$ of a balance jack; the joint space is formed by joint rotation angles $\theta_1$, $\theta_2$, $\theta_3$, and $\theta_4$ of the base, the rear linkage, the gob shield, and the roof beam; the pose space is formed by a support height h and an attitude angle $\vec{\alpha_4}$; and the detection space is formed by attitude angle variables of the base, the rear linkage, and the roof beam. It can be known from a conversion relationship between the working spaces that the pose space may be converted according to a one-to-one correspondence between the joint space and the detection space. Sensor information in the detection space is converted into a joint variable in the joint space, and the joint variable is then converted into a variable in the pose space by using a D-H matrix analysis method, where a sequence in a working space conversion procedure is "the detection space, the joint space, and the pose space".

When the detection space is converted into the joint space, measured attitude angle information of three axes is divided into $(\alpha_{1,x}, \alpha_{1,y}, \alpha_{1,z})$, $(\alpha_{2,x}, \alpha_{2,y}, \alpha_{2,z})$, and $(\alpha_{4,x}, \alpha_{4,y}, \alpha_{4,z})$. A four-linkage mechanism formed by the base, a front linkage, the rear linkage, and the gob shield may perform geometric conversion to obtain a rotation angle variable of the gob shield in the joint space. Coordinates of points A, B, C, and D in the coordinate system $\{O_2\}$ represent joint points corresponding to X in the coordinates, and coordinates of the joint points in the $\{O_2\}$ are respectively A(0, 0), $B(l_{AB}\sin(\alpha_{2,z}+\alpha_{1,z}-\xi_1), (l_{AB}\cos(\alpha_{2,x}+\alpha_{1,z}-\xi_1))$, $C(0, l_{AC})$, and $D(x_C^2-l_{CD}\sin(\varepsilon+\eta), y_C^2-l_{CD}\cos(\varepsilon+\eta))$, where intermediate parameters are solved according to the following expression:

$$\varepsilon = \arccos\frac{(l_{AC})^2 + (l_{BC})^2 - (l_{AB})^2}{2l_{AC}l_{BC}} \text{ and } \eta = \arccos\frac{(l_{BC})^2 + (l_{CD})^2 - (l_{BD})^2}{2l_{CD}l_{BC}},$$

where $l_{BC}$ is a distance between the point B and the point C in the four-linkage mechanism. As the four-linkage mechanism moves, the distance between the two points needs to be calculated in real time, and be solved as follows: $l_{BC}=\sqrt{(l_{AC})^2+(l_{AB})^2+2l_{AC}l_{BC}\cos(\alpha_{1,z}+\alpha_{2,z}-\xi_1)}$ and $$\xi_1 = \arcsin\left(\frac{l_{BB^*}-l_{OA}}{l_{AB}}\right).$$

Based on the solving of the intermediate variables, conversion from the detection space into the joint space may be implemented, and a specific conversion relationship is as follows: (where $\xi_1$ and $\xi_2$ are structural parameters of the hydraulic support)

$$\begin{cases} \theta_1 = \alpha_{1,z} \\ \theta_2 = \alpha_{2,z} + \theta_1 - \pi/2 \\ \theta_3 = \pi - \varepsilon - \eta - \xi_2 \\ \theta_4 = \pi/2 + \alpha_{4,z} - \theta_1 + \theta_2 - \theta_3 \end{cases}$$

When the joint space is converted into the pose space, the transformation matrix by which joint points of the hydraulic support in $\{O_i\}$ rotate about a Z axis in a longitudinal plane relative to the coordinate system $\{O_{i-1}\}$ (i=1, 2, 3, . . . ) is shown in the following expression:

$$rot(z, \theta_i) = \begin{bmatrix} \cos\theta_i & -\sin\theta_i & 0 & 0 \\ \sin\theta_i & \cos\theta_i & 0 & 0 \\ 0 & 0 & 1 & 0 \\ 0 & 0 & 0 & 1 \end{bmatrix}$$

$\theta_i$ is an angle of counterclockwise rotation about the Z axis, and a coordinate transformation matrix of the coordinate system $\{O_{i-1}\}$ (i=1, 2, 3, . . . ) is as follows:

$$T_{i-1}^{i} = Trans_{i-1}^{i}(x, y, z)rot(z, \theta_i) = \begin{bmatrix} \cos\theta_i & -\sin\theta_i & 0 & x \\ \sin\theta_i & \cos\theta_i & 0 & y \\ 0 & 0 & 1 & 0 \\ 0 & 0 & 0 & 1 \end{bmatrix}$$

A location coordinate of the point A in $\{O_1\}$ is $(x_A^1, y_A^1)$, which is easily obtained, and the transformation matrix of the base coordinate system $\{O_1\}$ of the hydraulic support relative to an absolute coordinate system $\{O_0\}$ is shown in the following expression:

$$T_0^1 = \begin{bmatrix} \cos\theta_1 & -\sin\theta_1 & 0 & x_A^1 \\ \sin\theta_1 & \cos\theta_1 & 0 & y_A^1 \\ 0 & 0 & 1 & 0 \\ 0 & 0 & 0 & 1 \end{bmatrix}$$

A location coordinate of the point C in $\{O_2\}$ is $(x_C^2, y_C^2)$, and the transformation matrix of the rear linkage coordinate system $\{O_2\}$ of the hydraulic support relative to the base coordinate system $\{O_1\}$ is shown in the following expression:

$$T_1^2 = \begin{bmatrix} \cos\theta_2 & -\sin\theta_2 & 0 & x_C^2 \\ \sin\theta_2 & \cos\theta_2 & 0 & y_C^2 \\ 0 & 0 & 1 & 0 \\ 0 & 0 & 0 & 1 \end{bmatrix}$$

A location coordinate of a point F in $\{O_3\}$ is $(x_F^3, y_F^3)$, and the transformation matrix of the gob shield coordinate system $\{O_3\}$ of the hydraulic support relative to the rear linkage coordinate system $\{O_2\}$ is shown in the following expression:

$$T_2^3 = \begin{bmatrix} \cos\theta_3 & -\sin\theta_3 & 0 & x_F^3 \\ \sin\theta_3 & \cos\theta_3 & 0 & y_F^3 \\ 0 & 0 & 1 & 0 \\ 0 & 0 & 0 & 1 \end{bmatrix}$$

A location coordinate of a point K in $\{O_4\}$ is $(x_K^4, y_K^4)$, and the transformation matrix of the roof beam coordinate system $\{O_4\}$ of the hydraulic support relative to the gob shield coordinate system $\{O_3\}$ is shown in the following expression:

$$T_3^4 = \begin{bmatrix} \cos\theta_4 & -\sin\theta_4 & 0 & x_K^4 \\ \sin\theta_4 & \cos\theta_4 & 0 & y_K^4 \\ 0 & 0 & 1 & 0 \\ 0 & 0 & 0 & 1 \end{bmatrix}$$

To unify conversion relationships between linkages, each transformation matrix may be represented by four geometric parameters of relationships between adjacent linkage coordinate systems of the D-H coordinate system, where the four geometric parameters are: a rotation angle $\theta_i$, which is a rotation angle at which linkages of the hydraulic support rotate about the Z axis from an $X_i$ axis in a direction parallel to an $X_{i-1}$ axis according to the right-hand rule; an offset $d_i$ is a vertical distance between a $Z_{i-1}$ axis and a $Z_i$ axis of the linkages of the hydraulic support; a linkage length $l_i$ is a distance between an intersection of the linkages of the hydraulic support from the $Z_{i-1}$ axis to the $Z_i$ axis and the $i^{th}$ coordinate origin along the $Z_i$ axis; a torsion angle $\alpha_i$ is a rotation angle at which the linkages of the hydraulic support rotate about the $Z_i$ axis from the $Z_{i-1}$ axis to the $Z_i$ axis according to the right-hand rule. The unified coordinate conversion matrix is as follows:

$$T_{i-1}^{i}(\theta_i) = \begin{bmatrix} \cos\theta_i & -\sin\theta_i\cos\alpha_i & \sin\theta_i\sin\alpha_i & l_i\cos\theta_i \\ \sin\theta_i & \cos\theta_i\cos\alpha_i & -\cos\theta_i\sin\alpha_i & l_i\sin\theta_i \\ 0 & \sin\alpha_i & \cos\alpha_i & d_i \\ 0 & 0 & 0 & 1 \end{bmatrix}$$

For the four-linkage mechanism of the hydraulic support (including the base, the rear linkage, and the gob shield), D-H matrix parameters are an rotation angle $\theta_i$, an offset $d_i$, a torsion angle $\alpha_i$, and a linkage length $l_i$, so that D-H matrix parameters of the base, the rear linkage, the gob shield, and the roof beam are respectively $\{\theta_1, d_1, \alpha_1, l_1\}$, $\{\theta_2, d_2, \alpha_2, l_2\}$, $\{\theta_3, d_3, \alpha_3, l_3\}$, and $\{\theta_4, d_4, \alpha_4, l_4\}$. After each rotation angle is obtained, a pose of any point in $\{O_0\}$ may be obtained by using the following expression:

$$P(x_\times^0, y_\times^0, z_\times^0) = RPY(\alpha_{1,x}, \alpha_{1,y}, \alpha_{1,z})\prod_{i=1}^{n}\{T_{i-1}^{i}(\theta_{i-1})\}P(x_\times^i, y_\times^i, 0)$$

RPY $(\alpha_{1,x}, \alpha_{1,y}, \alpha_{1,z})$ represents a rotation matrix of the base obtained according to a roll-pitch-yaw rotation sequence, which is calculated as follows:

$$RPY(\alpha, \beta, \gamma) = \begin{bmatrix} C_\alpha C_\beta & S_\alpha C_\beta & -S_\beta & 0 \\ S_\gamma S_\beta C_\alpha - C_\gamma S_\alpha & S_\gamma S_\beta S_\alpha + C_\gamma C_\alpha & S_\gamma C_\beta & 0 \\ C_\gamma S_\beta C_\alpha + S_\gamma S_\alpha & C_\gamma S_\beta S_\alpha - S_\gamma C_\alpha & C_\gamma C_\beta & 0 \\ 0 & 0 & 0 & 1 \end{bmatrix}$$

A support height reference point of the hydraulic support is determined as $K(x_K^4, y_K^4, 0)$, and in the longitudinal plane of the hydraulic support, a pose of an execution terminal point K may be represented as follows:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix}$$

The support height reference point K is any point on the roof beam; $P(x_k^0, y_k^0, 0)^Y$ is a coordinated component of a pose of the point K in the absolute coordinate system $\{O_0\}$ on the Y axis; $P(0, 0, 0)^Y$ is a coordinated component of a pose of the origin O in the absolute coordinate system $\{O_0\}$ on the Y axis; and $P(x_K^0, y_K^0, 0)$ is a coordinated value of the support height reference point K in the absolute coordinate system $\{O_0\}$.

$T_0^1(\theta_1)$ is the transformation matrix of the base coordinate system $\{O_1\}$ relative to the absolute coordinate system $\{O_0\}$; $T_1^2(\theta_2)$ is the transformation matrix of the rear linkage coordinate system $\{O_2\}$ relative to the base coordinate system $\{O_1\}$; $T_2^3(\theta_3)$ is the transformation matrix of the gob shield coordinate system $\{O_3\}$ relative to the rear linkage coordinate system $\{O_2\}$; and $T_3^4(\theta_4)$ is the transformation matrix of the roof beam coordinate system $\{O_4\}$ relative to the gob shield coordinate system $\{O_3\}$.

$P(x_K^4, x_K^4, 0)$ represents the pose of the point K in the roof beam coordinate system $\{O_4\}$, and is determined by structural parameters of the hydraulic support; and the foregoing coordinate conversion matrix $T_{i-1}(\theta_i)$ represents the transformation matrix of a joint site of the hydraulic support in $\{O_i\}$ relative to a coordinate system $\{O_{i-1}\}$, and is constructed by using D-H matrix parameters, where the D-H matrix parameters include a joint rotation angle $\theta_i$, an offset $d_i$, a torsion angle $\alpha_i$, and a linkage length $l_i$ (i=1, 2, 3, . . . ).

$\theta_1$, $\theta_2$, $\theta_3$, and $\theta_4$ respectively represent a rotation angle of the base, a rotation angle of the rear linkage, a rotation angle of the gob shield, and a rotation angle of the roof beam.

$\hat{a}=(a_x, a_y, a_z)$ is referred to as an approach vector, which represents a z axis of the roof beam in the absolute coordinate system; $\hat{o}=(o_x, o_y, o_z)$ is referred to as an attitude vector, which represents a y axis of the roof beam in the absolute coordinate system; and $\hat{n}=(n_x, n_y, n_z)=\hat{o}\times\hat{a}$ is referred to as an x axis of the roof beam in the absolute coordinate system.

$P(x_K^4, y_K^4, 0)$ is determined by structural parameters of the hydraulic support, and an attitude matrix is represented as:

$$A_4 = \begin{bmatrix} n_x & o_x & a_x \\ n_y & o_y & a_y \\ n_z & o_z & a_z \end{bmatrix}$$

A specific manner of verifying effectiveness of an x axis $\hat{n}=(n_x, n_y, n_z)=\hat{o}\times\hat{a}$ of the roof beam in the absolute coordinate system is that: a calculated value $\vec{\alpha'_4}=(\alpha'_{4,x}, \alpha'_{4,y}, \alpha'_{4,z})$ of the attitude angle of the roof beam of the hydraulic support may be calculated by using the following expression:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

The calculated value $\vec{\alpha'_4}$ of the attitude angle of the roof beam calculated by using the foregoing expression is compared with the attitude angle $\vec{\alpha_4}$ of the roof beam detected by the first IMU sensor mounted on the roof beam. If a difference between the two values is within an allowable error range, it indicates that the x axis of the roof beam in the absolute coordinate system, and the support height h may be calculated by using an expression of the support height h; and if the difference between the two values is beyond the allowable error range, the hydraulic support needs to be initialized.

The support height h of the hydraulic support may be determined by a vertical distance between the point K and the origin O of the base in a Y-axis direction, and the support height of the hydraulic support may be solved according to the following expression:

$$h=P(x_k^0,y_k^0,0)^Y-P(0,0,0)^Y$$

$P(X)^Y$ is defined as a coordinate component of a point X on the Y axis. The support height h and the attitude variables $\vec{\alpha_4}$ of the hydraulic support may be obtained through the foregoing analysis and calculation, that is, conversion from the joint space into the pose space is implemented.

Figure 5:
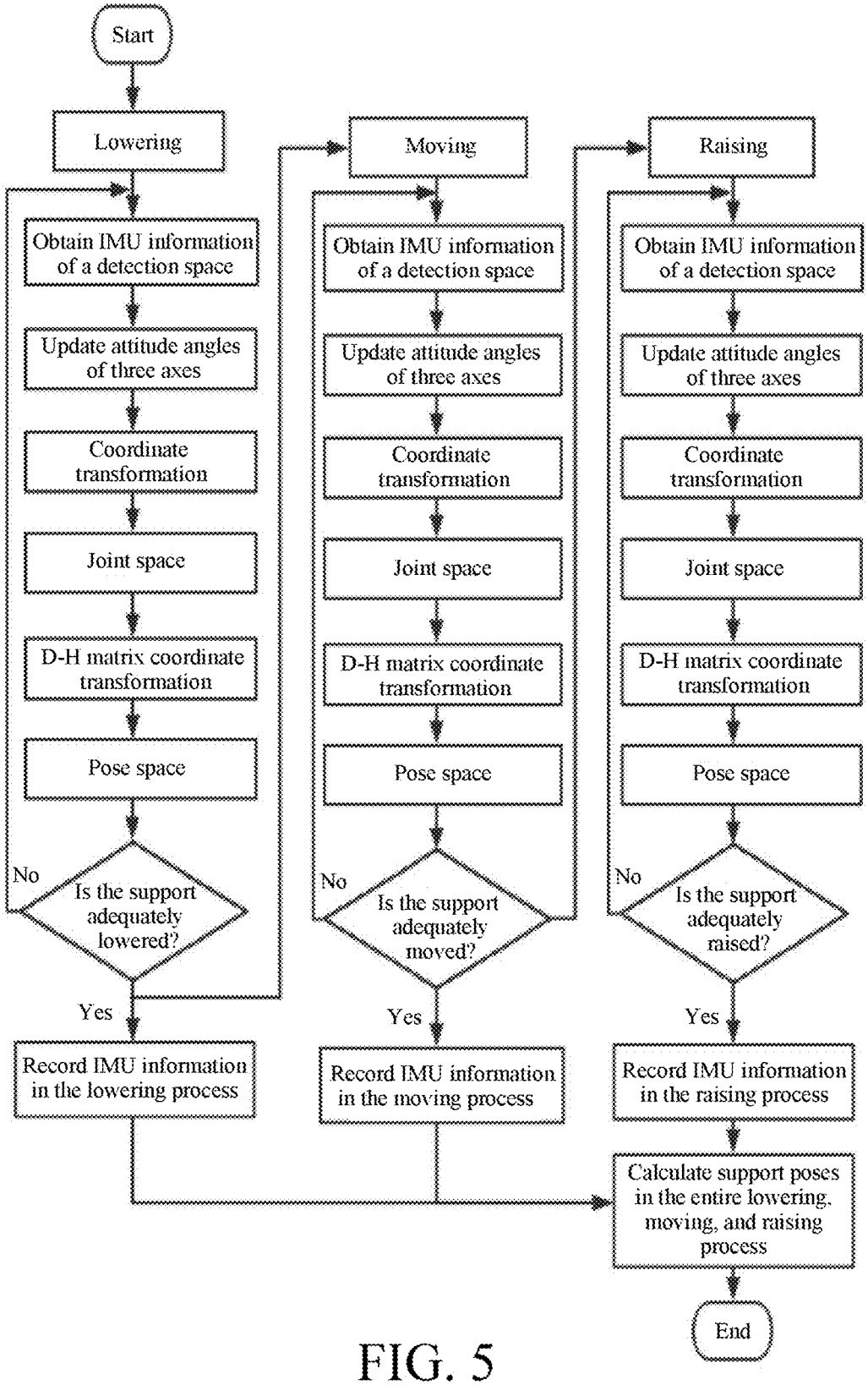
FIG. 5 is a flowchart of a method for detecting a support pose of a hydraulic support in real time, where in the accompanying drawing.

According to the hydraulic support, it can be known that the present invention may further provide a detection method of a hydraulic support monitoring a support pose based on an IMU. As shown in FIG. 5, in a step of lowering, moving or raising a hydraulic support in the detection method, a support pose of the hydraulic support needs to be monitored in real time to determine whether the hydraulic support has been lowered, moved or raised to reach a target support pose, where the support pose of the hydraulic support is represented by an attitude angle of a roof beam and a support height h of a support height reference point K selected on the roof beam. The detection method includes the following steps:

(1) in a process of lowering, moving or raising the support, recording pose information fed back by each IMU sensor in real time to update an attitude angle of a component on which the IMU sensor is mounted, where there are three IMU sensors, which are a first IMU sensor mounted on the roof beam, a second IMU sensor mounted on a rear linkage, and a third IMU sensor mounted on a base;

(2) performing coordinate conversion and geometric conversion by combining the pose information detected by each IMU sensor in an absolute coordinate system with the length of each bar in a four-linkage support mechanism to respectively obtain a joint rotation angle $\theta_1$ of the base, a joint rotation angle $\theta_2$ of the rear linkage, a joint rotation angle $\theta_3$ of the gob shield, and a joint rotation angle $\theta_4$ of the roof beam; and (3) performing coordinate conversion between an absolute coordinate system $\{O_0\}$ and a D-H coordinate system according to a D-H matrix coordinate transformation principle, according to the obtained joint rotation angle $\theta_1$ of the base, joint rotation angle $\theta_2$ of the rear linkage, joint rotation angle $\theta_3$ of the gob shield, and joint rotation angle $\theta_4$ of the roof beam, and by combining structural parameters of the hydraulic support and the attitude angle of the roof beam fed back by the first IMU sensor to obtain the support height h, where the support height h is expressed by a vertical distance between the support height reference point K and the origin O of the base in a Y-axis direction.

In the absolute coordinate system $\{O_0\}$, a horizontal direction of a longitudinal plane of the support is used as an X-axis direction, an upward direction perpendicular to the X axis in the longitudinal plane of the support is used as a Y-axis direction, and an outward direction perpendicular to the longitudinal plane of the support is used as a Z-axis direction. The base coordinate system $\{O_1\}$ is a D-H coordinate system established by using a point O as the origin; the rear linkage coordinate system $\{O_2\}$ is a D-H coordinate system established by using a joint site A between the rear linkage and the base as the origin; the gob shield coordinate system $\{O_3\}$ is a D-H coordinate system established by using a joint site C between the gob shield and the rear linkage as the origin; and the roof beam coordinate system $\{O_4\}$ is a D-H coordinate system established by using a joint site F between the roof beam and the gob shield as the origin.

It is determined, by comparing the calculated support height h with support height target values after the support is lowered, moved or raised, whether the hydraulic support is adequately lowered, moved or raised.

If in the lowering process, the calculated support height h is the same as a support height target value of lowering, it indicates that the support is adequately lowered, and the support starts to be moved; otherwise, the support continues being lowered;

if in the moving process, the calculated support height h is the same as a support height target value of moving, it indicates that the support is adequately moved, and the support starts to be raised; otherwise, the support continues being moved; and if in the raising process, the calculated support height h is the same as a support height target value of raising, it indicates that the support is adequately raised, and the entire operation procedure of the hydraulic support is ended; otherwise, the support continues being raised.

What is claimed is:

1. A hydraulic support comprising a base, a roof beam, a gob shield, a front linkage, a rear linkage, a column, and a balance jack, wherein the roof beam is supported above the base by the column, a tail end of the roof beam is hinged to one end of the gob shield, and an other end of the gob shield is provided with a site C and a site D that are spaced apart from each other; the site C and the site D of the gob shield are respectively hinged to a site A and a site B on the base by the front linkage and the rear linkage, to form a four-linkage support mechanism; one end of the balance jack is connected to the roof beam, and an other end of the balance jack is connected to the gob shield; and the hydraulic support further comprises three inertia measurement unit (IMU) sensors and a support pose monitoring system, wherein the three IMU sensors are a first IMU sensor, a second IMU sensor, and a third IMU sensor;

the first IMU sensor is mounted on the roof beam, and is configured to detect attitude angle information of the roof beam and feed the attitude angle information back to the support pose monitoring system;

the second IMU sensor is mounted on the rear linkage, and is configured to detect attitude angle information of the rear linkage and feed the attitude angle information back to the support pose monitoring system;

the third IMU sensor is mounted on the base, and is configured to detect attitude angle information of the base and feed the attitude angle information back to the support pose monitoring system; and the support pose monitoring system comprises an attitude angle information acquisition module, an attitude angle information analysis and processing module, and a support pose output module, wherein the attitude angle information acquisition module receives the attitude angle information detected by each of the three IMU sensors, and transmits the attitude angle information to the attitude angle information analysis and processing module; and the attitude angle information analysis and processing module receives the attitude angle information transmitted by the attitude angle information acquisition module, performs conversion calculation by combining received attitude angle information with a length of each bar in the four-linkage support mechanism and according to a D-H matrix coordinate conversion principle, to obtain a support height h of the hydraulic support, and compare an obtained support height h with a plurality of support height target values after a support is lowered, moved or raised, to determine whether the hydraulic support is adequately lowered, moved or raised, thereby monitoring a support pose of the hydraulic support in a process of lowering, moving or raising the hydraulic support.

2. The hydraulic support according to claim 1, wherein the attitude angle information analysis and processing module comprises:

a D-H coordinate conversion module, implementing a coordinate conversion by using an absolute coordinate system $\{O_0\}$ and a D-H coordinate system, wherein the D-H coordinate system comprises a base coordinate system $\{O_1\}$, a rear linkage coordinate system $\{O_2\}$, a gob shield coordinate system $\{O_3\}$, and a roof beam coordinate system $\{O_4\}$;

in the absolute coordinate system $\{O_0\}$, a horizontal direction of a longitudinal plane of the hydraulic support is used as an X-axis direction, an upward direction perpendicular to an X axis in the longitudinal plane of the hydraulic support is used as a Y-axis direction, and an outward direction perpendicular to the longitudinal plane of the hydraulic support is used as a Z-axis; the base coordinate system $\{O_1\}$ is a D-H coordinate system established by using a point O as an origin; the rear linkage coordinate system $\{O_2\}$ is a D-H coordinate system established by using a joint site A between the rear linkage and the base as an origin; the gob shield coordinate system $\{O_3\}$ is a D-H coordinate system established by using a joint site C between the gob shield and the rear linkage as an origin; the roof beam coordinate system $\{O_4\}$ is a D-H coordinate system established by using a joint site F between the roof beam and the gob shield as an origin;

the D-H coordinate conversion module comprises a joint rotation angle conversion module and a support pose conversion module, wherein the joint rotation angle conversion module performs a geometric conversion according to the received attitude angle information and by combining the length of the each bar in the four-linkage support mechanism to respectively obtain a joint rotation angle $\theta_1$ of the base, a joint rotation angle $\theta_2$ of the rear linkage, a joint rotation angle $\theta_3$ of the gob shield, a joint rotation angle $\theta_4$ of the roof beam, and transmits a plurality of obtained joint rotation angles to the support pose conversion module; and the support pose conversion module obtains the support height h of the hydraulic support according to a D-H coordinate conversion principle, by using a D-H matrix analysis method, and by combining each joint rotation angle transmitted by the joint rotation angle conversion module.

3. The hydraulic support monitoring IMU according to claim 2, wherein the support pose conversion module expresses the support height h by using a vertical distance between a support height reference point K and an origin O of the base in the Y-axis direction:

$$h=P(x_k^0,y_k^0,0)^Y-P(0,0,0)^Y$$

in the expression, a pose $P(x_K^0, y_K^0, 0)$ of the support height reference point K in the longitudinal plane of the hydraulic support is determined by using the following expression:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix};$$

a difference between a calculated value $\vec{\alpha'_4}$ of an attitude angle of the roof beam and an attitude angle $\vec{\alpha_4}$ of the roof beam detected by the first IMU sensor mounted on the roof beam is within an allowable error range, and an expression of a calculated value $\vec{\alpha'_4}=(\alpha'_{4,x}, \alpha'_{4,y}, \alpha'_{4,z})$ of the attitude angle of the roof beam of the hydraulic support is:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

the support height reference point K is any point on the roof beam; $P(x_K^0, y_K^0, 0)$ is a coordinate value of the support height reference point K in the absolute coordinate system $\{O_0\}$; $P(0, 0, 0)^Y$ is a coordinate value of the origin O of the base in the absolute coordinate system $\{O_0\}$;

$T_0^1(\theta_1)$ is a transformation matrix of the base coordinate system $\{O_1\}$ relative to the absolute coordinate system $\{O_0\}$; $T_1^2(\theta_2)$ is a transformation matrix of the rear linkage coordinate system $\{O_2\}$ relative to the base coordinate system $\{O_1\}$; $T_2^3(\theta_3)$ is a transformation matrix of the gob shield coordinate system $\{O_3\}$ relative to the rear linkage coordinate system $\{O_2\}$; and $T_3^4(\theta_4)$ is a transformation matrix of the roof beam coordinate system $\{O_4\}$ relative to the gob shield coordinate system $\{O_3\}$;

$P(x_K^4, y_K^4, 0)$ represents a pose of the point K in the roof beam coordinate system $\{O_4\}$, and is determined by a plurality of structural parameters of the hydraulic support; and a coordinate conversion matrix $T_{i-1}^i(\theta_i)$ represents a transformation matrix of a joint site of the hydraulic support in $\{O_i\}$ relative to a coordinate system $\{O_{i-1}\}$, and is constructed by using a plurality of D-H matrix parameters, wherein the plurality of D-H matrix parameters comprise a joint rotation angle $\theta_i$, an offset $d_i$, and a torsion angle $\alpha_i$, and a linkage length $l_i$ (i=1, 2, 3, . . . );

$\theta_1$, $\theta_2$, $\theta_3$, and $\theta_4$ respectively represent a rotation angle of the base, a rotation angle of the rear linkage, a rotation angle of the gob shield, and a rotation angle of the roof beam; and $\hat{a}=(a_x, a_y, a_x)$ is referred to as an approach vector and represents a z axis of the roof beam in the absolute coordinate system; $\hat{o}=(o_x, o_y, o_z)$ is referred to as an attitude vector and represents a y axis of the roof beam in the absolute coordinate system; and $\hat{n}=(n_x, n_y, n_z)=\hat{o}\times\hat{a}$ represents an x axis of the roof beam in the absolute coordinate system.

4. The hydraulic support according to claim 2, wherein in the joint rotation angle conversion module, the joint rotation angle $\theta_1$ of the base, the joint rotation angle $\theta_2$ of the rear linkage, the joint rotation angle $\theta_3$ of the gob shield, and the joint rotation angle $\theta_4$ of the roof beam are calculated by using the following expression:

$$\begin{cases} \theta_1 = \alpha_{1,z} \\ \theta_2 = \alpha_{2,z} + \theta_1 - \pi/2 \\ \theta_3 = \pi - \varepsilon - \eta - \xi_2 \\ \theta_4 = \pi/2 + \alpha_{4,z} - \theta_1 + \theta_2 - \theta_3 \end{cases}$$

$\alpha_{1,z}$ is a component of an attitude angle of the base in the absolute coordinate system $\{O_0\}$ in a Z direction; $\alpha_{2,z}$ is a component of an attitude angle of the rear linkage in the absolute coordinate system $\{O_0\}$ in the Z direction; $\alpha_{4,z}$ is a component of an attitude angle of the roof beam in the absolute coordinate system $\{O_0\}$ in the $\xi_1$ direction; $\xi_2$ and a are structural parameters of the hydraulic support, and $\varepsilon$ and $\eta$ are intermediate parameters; and expressions of the structural parameters $\xi_1$ and $\xi_2$ of the hydraulic support and the intermediate parameters $\varepsilon$ and $\eta$ are as follows:

$$\xi_1 = \arcsin\left(\frac{l_{BB^*} - l_{0A}}{l_{AB}}\right)$$

$$\xi_2 = arcos\left(\frac{l_{CC^*}}{l_{CD}}\right)$$

$$\varepsilon = \arccos\frac{(l_{AC})^2 + (l_{BC})^2 - (l_{AB})^2}{2l_{AC}l_{BC}}$$

$$\eta = \arccos\frac{(l_{BC})^2 + (l_{CD})^2 - (l_{BD})^2}{2l_{CD}l_{BC}}$$

in the expression, $l_{AB}$ is a distance between the joint site A and the joint site B in the four-linkage support mechanism; $l_{BC}$ is a distance between the joint site B and the joint site C in the four-linkage support mechanism, wherein $l_{BS}=\sqrt{(l_{AC})^2+(l_{AB})^2+2l_{AC}l_{BC}\cos(\alpha_{1,z}+\alpha_{2,z}-\xi_1)}$; $l_{AC}$ is a distance between the joint site A and the joint site C in the four-linkage support mechanism; $l_{CD}$ is a distance between the joint site D and the joint site C in the four-linkage support mechanism; $l_{CC*}$ is a distance between the joint site C and DC* in the four-linkage support mechanism, wherein C* is a foot point; $l_{BD}$ is a distance between the joint site B and the joint site D in the four-linkage support mechanism; $l_{BB*}$ is a distance between the joint site B and the base in the four-linkage support mechanism, wherein B* is a foot point of the joint site B on the base; and $l_{OA}$ is a distance between the joint site A and the origin O of the absolute coordinate system $\{O_0\}$ on the base in the hydraulic support.

5. The hydraulic support according to claim 4, wherein the support pose conversion module expresses the support height h by using a vertical distance between a support height reference point K and an origin O of the base in the Y-axis direction:

$$h=P(x_K^0,y_K^0,0)^Y-P(0,0,0)^Y$$

in the expression, a pose $P(x_K^0, y_K^0, 0)$ of the support height reference point K in the longitudinal plane of the hydraulic support is determined by using the following expression:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix}$$

a difference between a calculated value $\overrightarrow{\alpha'_4}$ of an attitude angle of the roof beam and an attitude angle $\overrightarrow{\alpha_4}$ of the roof beam detected by the first IMU sensor mounted on the roof beam is within an allowable error range, and an expression of a calculated value $\overrightarrow{\alpha'_4}=(\alpha'_{4,x}\alpha'_{4,y}\alpha'_{4,z})$ of the attitude angle of the roof beam of the hydraulic support is:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

the support height reference point K is any point on the roof beam; $P(x_K^0, y_K^0, 0)$ is a coordinate value of the support height reference point K in the absolute coordinate system $\{O_0\}$; $P(0, 0, 0)^Y$ is a coordinate value of the origin O of the base in the absolute coordinate system $\{O_0\}$;

$T_0^1(\theta_1)$ is a transformation matrix of the base coordinate system $\{O_1\}$ relative to the absolute coordinate system $\{O_0\}$; $T_1^2(\theta_2)$ is a transformation matrix of the rear linkage coordinate system $\{O_2\}$ relative to the base coordinate system $\{O_1\}$; $T_2^3(\theta_3)$ is a transformation matrix of the gob shield coordinate system $\{O_3\}$ relative to the rear linkage coordinate system $\{O_2\}$; and $T_3^4(\theta_4)$ is a transformation matrix of the roof beam coordinate system $\{O_4\}$ relative to the gob shield coordinate system $\{O_3\}$;

$P(x_K^4, y_K^4, 0)$ represents a pose of the point K in the roof beam coordinate system $\{O_4\}$, and is determined by a plurality of structural parameters of the hydraulic support; and a coordinate conversion matrix $T_{i-1}^i(\theta_i)$ represents a transformation matrix of a joint site of the hydraulic support in $\{\theta_i\}$ relative to a coordinate system $\{\theta_{i-1}\}$, and is constructed by using a plurality of D-H matrix parameters, wherein the plurality of D-H matrix parameters comprise a joint rotation angle $\theta_i$, an offset $d_i$, and a torsion angle $\alpha_i$, and a linkage length $l_i$ (i=1, 2, 3, . . . );

$\theta_1$, $\theta_2$, $\theta_3$, and $\theta_4$ respectively represent a rotation angle of the base, a rotation angle of the rear linkage, a rotation angle of the gob shield, and a rotation angle of the roof beam; and $\hat{a}=(a_x, a_y, a_z)$ is referred to as an approach vector and represents a z axis of the roof beam in the absolute coordinate system; $\hat{o}=(o_x, o_y, o_z)$ is referred to as an attitude vector and represents a y axis of the roof beam in the absolute coordinate system; and $\hat{n}=(n_x, n_y, n_z)=\hat{o}\times\hat{a}$ represents an x axis of the roof beam in the absolute coordinate system.

6. A method for detecting a support pose of a hydraulic support, wherein in a step of lowering, moving or raising a hydraulic support, a support pose of the hydraulic support needs to be monitored in real time to determine whether the hydraulic support has been lowered, moved or raised to reach a target support pose, wherein hydraulic support further comprises three inertia measurement unit (IMU) sensors and a support pose monitoring system, and wherein the support pose of the hydraulic support is represented by an attitude angle of a roof beam and a support height h of a support height reference point K selected on the roof beam; and the detection method comprises the following steps:

(1) in a process of lowering, moving or raising the support, recording pose information fed back by each IMU sensors and a support pose monitoring system IMU sensor in real time to update an attitude angle of a component on which the each IMU sensor is mounted, wherein the three IMU sensors comprises of a first IMU sensor mounted on the roof beam, a second IMU sensor mounted on a rear linkage, and a third IMU sensor mounted on a base;

(2) performing a coordinate conversion and a geometric conversion by combining the pose information detected by the each IMU sensor of the three IMU sensors in an absolute coordinate system with a length of each bar in a four-linkage support mechanism to respectively obtain a joint rotation angle $\theta_1$ of the base, a joint rotation angle $\theta_2$ of the rear linkage, a joint rotation angle $\theta_3$ of a gob shield, and a joint rotation angle $\theta_4$ of the roof beam; and (3) performing the coordinate conversion between an absolute coordinate system $\{O_0\}$ and a D-H coordinate system according to a D-H matrix coordinate transformation principle, according to an obtained joint rotation angle $\theta_1$ of the base, joint rotation angle $\theta_2$ of the rear linkage, joint rotation angle $\theta_3$ of the gob shield, and joint rotation angle $\theta_4$ of the roof beam, and by combining a plurality of structural parameters of the hydraulic support and the attitude angle of the roof beam fed back by the first IMU sensor to obtain the support height h, wherein the support height h is expressed by a vertical distance between the support height reference point K and an origin O of the base in a Y-axis direction;

in the absolute coordinate system $\{O_0\}$, a horizontal direction of a longitudinal plane of the hydraulic support is used as an X-axis direction, an upward direction perpendicular to the X axis in the longitudinal plane of the hydraulic support is used as the Y-axis direction, and an outward direction perpendicular to the longitudinal plane of the hydraulic support is used as a Z-axis; the base coordinate system $\{O_1\}$ is a D-H coordinate system established by using a point O as an origin; the rear linkage coordinate system $\{O_2\}$ is a D-H coordinate system established by using a joint site A between the rear linkage and the base as an origin; the gob shield coordinate system $\{O_3\}$ is a D-H coordinate system established by using a joint site C between the gob shield and the rear linkage as an origin; and the roof beam coordinate system $\{O_4\}$ is a D-H coordinate system established by using a joint site F between the roof beam and the gob shield as an origin; wherein the hydraulic support includes a front linkage, the joint site C and the joint site D of the gob shield are respectively hinged to a joint site A and a joint site B on the base by the front linkage and the rear linkage, to form the four-linkage support mechanism; and determining, by comparing a calculated support height h with a plurality of support height target values after the hydraulic support is lowered, moved or raised, whether the hydraulic support is adequately lowered, moved or raised, wherein if in a lowering process, the calculated support height h is the same as a support height target value of lowering, the hydraulic support is adequately lowered, and the hydraulic support starts to be moved; otherwise, the hydraulic support continues being lowered;

if in a moving process, the calculated support height h is the same as a support height target value of moving, the hydraulic support is adequately moved, and the hydraulic support starts to be raised; otherwise, the hydraulic support continues being moved; and if in a raising process, the calculated support height h is the same as a support height target value of raising, the hydraulic support is adequately raised, and the entire operation procedure of the hydraulic support is ended; otherwise, the hydraulic support continues being raised.

7. The method for detecting the support pose of the hydraulic support according to claim 6, wherein in step (2), a plurality of expressions of the joint rotation angle $\theta_1$ of the base, the joint rotation angle $\theta_2$ of the rear linkage, the joint rotation angle $\theta_3$ of the gob shield, and the joint rotation angle $\theta_4$ of the roof beam are calculated by using the following steps:

2.1. first, calculating a plurality of coordinates of the joint sites A, B, C, and D in the coordinate system $\{O_2\}$ in the four-linkage support mechanism formed by the base, the front linkage, the rear linkage, and the gob shield, which are A(0, 0), B($l_{AB}$ sin($\alpha_{2,z}+\alpha_{1,z}-\xi_1$), $l_{AB}$ cos($\alpha_{2,z}+\alpha_{1,z}-\xi_1$), C(0, $l_{AC}$), and D(xc$^2$−lCD sine ε+η, yc$^2$−lCD cos ε+η);

2.2. calculating the distance $l_{BC}=\sqrt{(l_{AC})^2+(l_{AB})^2+2l_{AC}l_{BC}\cos(\alpha_{1,z}+\alpha_{2,z}-\xi_1)}$ between the joint site B and the joint site C in the four-linkage support mechanism in real time; and 2.3. obtaining the plurality of expressions of the joint rotation angles $\theta_1$, $\theta_2$, $\theta_3$, and $\theta_4$ according to step 2.1 and step 2.2 and by combining the intermediate parameters ε and η, wherein each expression is as follows:

$$\begin{cases} \theta_1 = \alpha_{1,z} \\ \theta_2 = \alpha_{2,z} + \theta_1 - \pi/2 \\ \theta_3 = \pi - \varepsilon - \eta - \xi_2 \\ \theta_4 = \pi/2 + \alpha_{4,z} - \theta_1 + \theta_2 - \theta_3 \end{cases}$$

where $\alpha_{1,z}$ is the component of the attitude angle of the base in the absolute coordinate system $\{O_0\}$ in the Z direction; $\alpha_{2,z}$ is the component of the attitude angle of the rear linkage in the absolute coordinate system $\{O_0\}$ in the Z direction; $\alpha_{4,z}$ is the component of the attitude angle of the roof beam in the absolute coordinate system $\{O_0\}$ in the Z direction; $\xi_1$ and $\xi_2$ are structural parameters of the hydraulic support, and ε and η are intermediate parameters; expressions of the structural parameters $\xi_1$ and $\xi_2$ of the hydraulic support and the intermediate parameters ε and η are as follows:

$$\xi_1 = \arcsin\left(\frac{l_{BB^*} - l_{0A}}{l_{AB}}\right)$$

$$\xi_2 = arcos\left(\frac{l_{CC^*}}{l_{CD}}\right)$$

$$\varepsilon = \arccos\frac{(l_{AC})^2 + (l_{BC})^2 - (l_{AB})^2}{2l_{AC}l_{BC}}$$

$$\eta = \arccos\frac{(l_{BC})^2 + (l_{CD})^2 - (l_{BD})^2}{2l_{CD}l_{BC}}$$

in the expressions: $l_{AB}$ is the distance between the joint site A and the joint site B in the four-linkage support mechanism; $l_{BC}$ is the distance between the joint site B and the joint site C in the four-linkage support mechanism; $l_{AC}$ is the distance between the joint site A and the joint site C in the four-linkage support mechanism; $l_{CD}$ is the distance between the joint site D and the joint site C in the four-linkage support mechanism; $l_{CC^*}$ is the distance between the joint site C and DC* in the four-linkage support mechanism, wherein C* is the foot point; $l_{BD}$ is the distance between the joint site B and the joint site D in the four-linkage support mechanism; $l_{BB^*}$ is the distance between the joint site B and the base in the four-linkage support mechanism, wherein B* is the foot point of the joint site B on the base; and $l_{OA}$ is the distance between the joint site A and the origin O of the absolute coordinate system $\{O_0\}$ on the base in the hydraulic support.

8. The method for detecting the support pose of the hydraulic support according to claim 6, wherein an expression of the support height h is obtained by using the following steps:

3.1. constructing a transformation matrix $T_{i-1}^{i}(\theta_i)$ by which a joint site of the hydraulic support in $\{O_i\}$ rotates about the Z axis in the longitudinal plane of the hydraulic support relative to the coordinate system $\{O_{i-1}\}$, wherein i=1, 2, 3, . . . ;

3.2. uniformly constructing $T_{i-1}^{i}(\theta_i)$ by using a plurality of D-H matrix parameters, wherein the plurality of D-H matrix parameters are a rotation angle $\theta_i$, an offset $d_i$, a torsion angle $\alpha_i$, and a linkage length $l_i$;

3.3. solving a pose of any point X on the hydraulic support in the absolute coordinate system $\{O_0\}$ by using each rotation angle $\theta_i$, wherein $$P(x_x^0, y_x^0, z_x^0) = RPY(\alpha_{1,x}, \alpha_{1,y}, \alpha_{1,z})\prod_{i=1}^{n}\{T_{i-1}^{i}(\theta_{i-1})\}P(x_x^i, y_x^i, 0)$$

RPY ($\alpha_{1,x}$, $\alpha_{1,y}$, $\alpha_{1,z}$) represents a rotation matrix of the base obtained according to a roll-pitch-yaw rotation sequence;

3.4. selecting a point K on the roof beam as a support height reference point of the hydraulic support, wherein an expression of a pose of the point K in the absolute coordinate system $\{O_0\}$ in the longitudinal plane of the hydraulic support is as follows:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix}$$

$P(x_K^0, y_K^0, 0)$ is a coordinate value of a support height reference point K in the absolute coordinate system $\{O_0\}$; and $P(0, 0, 0)^Y$ is a coordinate value of the origin O of the base in the absolute coordinate system $\{O_0\}$;

$T_0^1(\theta_1)$ is a transformation matrix of the base coordinate system $\{O_1\}$ relative to the absolute coordinate system $\{O_0\}$; $T_2^3(\theta_3)$ is a transformation matrix of the rear linkage coordinate system $\{O_2\}$ relative to the base coordinate system $\{O_1\}$; $T_2^3(\theta_3)$ is a transformation matrix of the gob shield coordinate system $\{O_3\}$ relative to the rear linkage coordinate system $\{O_2\}$; and $T_3^4(\theta_4)$ is a transformation matrix of the roof beam coordinate system $\{O_4\}$ relative to the gob shield coordinate system $\{O_3\}$;

$P(x_K^4, y_K^4, 0)$ represents the pose of the point K in the roof beam coordinate system $\{O_4\}$, and is determined by a plurality of structural parameters of the hydraulic support; a foregoing coordinate conversion matrix $T_{i-1}^i(\theta_i)$ represents a transformation matrix of a joint site of the hydraulic support in $\{O_i\}$ relative to the coordinate system $\{O_{i-1}\}$, and is constructed by using the plurality of D-H matrix parameters, wherein the plurality of D-H matrix parameters comprise a joint rotation angle $\theta_i$, an offset $d_i$, a torsion angle $\alpha_i$, and a linkage length $l_i$ (i=1, 2, 3, . . . );

$\theta_1$, $\theta_2$, $\theta_3$, and $\theta_4$ respectively represent a rotation angle of the base, a rotation angle of the rear linkage, a rotation angle of the gob shield, and a rotation angle of the roof beam; and $\hat{a}=(a_x, a_y, a_z)$ is referred to as an approach vector and represents a z axis of the roof beam in the absolute coordinate system; $\hat{o}=(o_x, o_y, o_z)$ is referred to as an attitude vector and represents a y axis of the roof beam in the absolute coordinate system; $\hat{n}=(n_x, n_y, n_z)=\hat{o}\times\hat{a}$ represents an x axis of the roof beam in the absolute coordinate system;

3.5. an attitude matrix of the hydraulic support being:

$$A_4 = \begin{bmatrix} n_x & o_x & a_x \\ n_y & o_y & a_y \\ n_z & o_z & a_z \end{bmatrix}$$

3.6. verifying effectiveness of an x axis $\hat{n}=(n_x, n_y, n_z)=\hat{o}\times\hat{a}$ of the roof beam in the absolute coordinate system in a pose $P(x_K^0, y_K^0, 0)$ and a pose matrix of the hydraulic support, wherein a specific manner is that:

a calculated value $\vec{\alpha'_4}=(\alpha'_{4,x}, \alpha'_{4,y}, \alpha'_{4,z})$ of the attitude angle of the roof beam of the hydraulic support is calculated by using the following expression:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

comparing the calculated value $\vec{\alpha'_4}=(\alpha'_{4,x}, \alpha'_{4,y}, \alpha'_{4,z})$ of a roof beam attitude angle of the hydraulic support obtained by using the foregoing expression with the attitude angle $\vec{\alpha_4}$ of the roof beam detected by the first IMU sensor mounted on the roof beam, wherein if a difference between the two values is within an allowable error range, the support height h is calculated by using the expression of the support height h; and if the difference between the two values is beyond the allowable error range, the hydraulic support needs to be initialized; and 3.7. calculating the support height h of the hydraulic support:

$$h=P(x_K^0,y_K^0,0)^Y-P(0,0,0)^Y$$

in the expression: $P(x_K^0, y_K^0, 0)^Y$ is a coordinate component of the pose of the point K in the absolute coordinate system $\{O_0\}$ on the Y axis; and $P(0, 0, 0)^Y$ is a coordinate component of a pose of the origin O in the absolute coordinate system $\{O_0\}$ on the Y axis.

9. The method for detecting the support pose of the hydraulic support according to claim 6, wherein in step (3), an expression of the support height h is as follows:

$$h=P(x_K^0,y_K^0,0)^Y-P(0,0,0)^Y$$

in the expression: a pose $P(x_K^0, y_K^0, 0)$ of the support height reference point K in the longitudinal plane of the hydraulic support is determined by using the following expression:

$$P(x_K^0, y_K^0, 0) = T_0^1(\theta_1)T_1^2(\theta_2)T_2^3(\theta_3)T_3^4(\theta_4)P(x_K^4, y_K^4, 0) = \begin{bmatrix} n_x & o_x & a_x & x_K^0 \\ n_y & o_y & a_y & y_K^0 \\ n_z & o_z & a_z & 0 \\ 0 & 0 & 0 & 1 \end{bmatrix};$$

a difference between a calculated value $\vec{\alpha'_4}$ of the attitude angle of the roof beam and an attitude angle $\vec{\alpha'_4}$ of the roof beam detected by the first IMU sensor mounted on the roof beam is within an allowable error range, and an expression of the calculated value $\vec{\alpha'_4}=(\alpha'_{4,x}, \alpha'_{4,y}, \alpha'_{4,z})$ of the attitude angle of the roof beam of the hydraulic support is:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

a support height reference point K is any point on the roof beam; $P(x_K^0, y_K^0, 0)^Y$ is a coordinate component of a pose of the support height reference point K in the absolute coordinate system $\{O_0\}$ on the Y axis; $P(0, 0, 0)^Y$ is a coordinate component of a pose of the origin O in the absolute coordinate system $\{O_0\}$ on the Y axis;

$P(x_K^0, y_K^0, 0)$ is a coordinate value of the support height reference point K in the absolute coordinate system $\{O_0\}$;

$Y_0^1(\theta_1)$ is a transformation matrix of a base coordinate system $\{O_1\}$ relative to the absolute coordinate system $\{O_0\}$; $T_1^2(\theta_2)$ is a transformation matrix of the rear linkage coordinate system $\{O_2\}$ relative to the base coordinate system $\{O_1\}$; $T_2^3(\theta_3)$ is a transformation matrix of the gob shield coordinate system $\{O_3\}$ relative to the rear linkage coordinate system $\{O_2\}$; and $T_3^4(\theta_4)$ is a transformation matrix of the roof beam coordinate system $\{O_4\}$ relative to the gob shield coordinate system $\{O_3\}$;

$P(x_K^4, y_K^4, 0)$ represents a pose of the point K under the roof beam coordinate system $\{O_4\}$, and is determined by a hydraulic support structural parameter; a foregoing coordinate transformation matrix $T_{i-1}^i(\theta_i)$ represents a transformation matrix of a joint site of the hydraulic support in $\{O_i\}$ relative to a coordinate system $\{O_{i-1}\}$, and is constructed by using a plurality of D-H matrix parameters, and the plurality of D-H matrix parameters comprise a joint rotation angle $\theta_i$, an offset $d_i$, a torsion angle $\alpha_i$, and a linkage length $l_i$ (i=1, 2, 3, . . . );

$\theta_1$, $\theta_2$, $\theta_3$, and $\theta_4$ respectively represent a rotation angle of the base, a rotation angle of the rear linkage, a rotation angle of the gob shield, and a rotation angle of the roof beam;

$\hat{a}=(a_x, a_y, a_z)$ is referred to as an approach vector and represents a z axis of the roof beam in the absolute coordinate system; $\hat{o}=(o_x, o_y, o_z)$ is referred to as an attitude vector and represents a y axis of the roof beam in the absolute coordinate system; $\hat{n}=(n_x, n_y, n_z)=\hat{o}\times\hat{a}$ represents an x axis of the roof beam in the absolute coordinate system; and after the pose $P(x_K^0, y_K^0, 0)$ is calculated, it is necessary to verify effectiveness of the roof beam on the x axis of the absolute coordinate system $\hat{n}=(n_x, n_y, n_z)$ in the pose $P(x_K^0, y_K^0, 0)$, wherein the specific manner is that: a calculated value $\vec{\alpha}'_4=(\alpha'_{4,x}, \alpha'_{4,y}, \alpha'_{4,z})$ of a roof beam attitude angle of the hydraulic support is calculated by using the following expression:

$$\begin{cases} \alpha'_{4,z} = \text{atan2}(n_y, n_x) \\ \alpha'_{4,y} = \text{atan2}(-n_z, n_x\cos\alpha'_{4,z} + n_y\sin\alpha'_{4,z}) \\ \alpha'_{4,x} = \text{atan2}(\alpha_x\sin\alpha'_{4,z} - \alpha_y\cos\alpha'_{4,z}, o_y\cos\alpha'_{4,z} - o_x\sin\alpha'_{4,z}) \end{cases}$$

comparing the calculated value $\vec{\alpha}'_4$ of the roof beam attitude angle of the hydraulic support obtained by using the foregoing expression with the roof beam attitude angle $\vec{\alpha}_4$ detected by the first IMU sensor mounted on the roof beam, wherein if a difference between the two values is within an allowable error range, the support height h is calculated by using the expression of the support height h; and if the difference between the two values is beyond the allowable error range, the hydraulic support needs to be initialized.

10. The method for detecting the support pose of the hydraulic support according to claim 6, wherein the joint rotation angle $\theta_1$ of the base, the joint rotation angle $\theta_2$ of the rear linkage, the joint rotation angle $\theta_3$ of the gob shield, and the joint rotation angle $\theta_4$ of the roof beam are calculated by using the following expression:

$$\begin{cases} \theta_1 = \alpha_{1,z} \\ \theta_2 = \alpha_{2,z} + \theta_1 - \pi/2 \\ \theta_3 = \pi - \varepsilon - \eta - \xi_2 \\ \theta_4 = \pi/2 + \alpha_{4,z} - \theta_1 + \theta_2 - \theta_3 \end{cases}$$

wherein $a_{1,z}$ is the component of an attitude angle of the base in the absolute coordinate system $\{O_0\}$ in a Z direction; $a_{2,z}$ is the component of the attitude angle of the rear linkage in the absolute coordinate system $\{O_0\}$ in the Z direction; $a_{4,z}$ is the component of the attitude angle of the roof beam in the absolute coordinate system $\{O_0\}$ in the Z direction; $\xi$1 and $\xi$2 are the hydraulic support structural parameters, and $\varepsilon$ and $\eta$ are intermediate parameters; expressions of the structural parameters $\xi$1 and $\xi$2 of the hydraulic support and the intermediate parameters $\varepsilon$ and $\eta$ are as follows:

$$\xi_1 = \arcsin\left(\frac{l_{BB^*} - l_{0A}}{l_{AB}}\right)$$

$$\xi_2 = arcos\left(\frac{l_{CC^*}}{l_{CD}}\right)$$

$$\varepsilon = \arccos\frac{(l_{AC})^2 + (l_{BC})^2 - (l_{AB})^2}{2l_{AC}l_{BC}}$$

$$\eta = \arccos\frac{(l_{BC})^2 + (l_{CD})^2 - (l_{BD})^2}{2l_{CD}l_{BC}}$$

in the expression: $l_{AB}$ is the distance between the joint site A and the joint site B in the four-linkage support mechanism; $l_{BC}$ is the distance between the joint site B and the joint site C in the four-linkage support mechanism, wherein $l_{BC}=\sqrt{(l_{AC})^2+(l_{AB})^2+2l_{AC}l_{BC}\cos(a_{1,z}+a_{2,z}-\xi_1)}$;

$l_{AC}$ is the distance between the joint site A and the joint site C in the four-linkage support mechanism; $l_{CD}$ is the distance between the joint site D and the joint site C in the four-linkage support mechanism; $l_{CC^*}$ is the distance between the joint site C and DC* in the four-linkage support mechanism, wherein C* is the foot point; $l_{BD}$ is the distance between the joint site B and the joint site D in the four-linkage support mechanism; $l_{BB^*}$ is the distance between the joint site B and the base in the four-linkage support mechanism, wherein B* is the foot point of the joint site B on the base; and $l_{OA}$ is the distance between the joint site A and the origin O of the absolute coordinate system $\{O_0\}$ on the base in the hydraulic support.

* * * * *